US005806487A

United States Patent [19]

Dolenc

[11] Patent Number: 5,806,487

[45] Date of Patent: Sep. 15, 1998

[54] FUEL INJECTION PUMP UNIT WITH CONTROL AND PROCESS FOR ITS CALIBRATION

[75] Inventor: Anton Dolenc, Vienna, Austria

[73] Assignee: Steyr-Daimler-Puch Aktiengesellschaft, Vienna, Austria

[21] Appl. No.: 860,337

[22] PCT Filed: Dec. 22, 1995

[86] PCT No.: PCT/AT95/00251

§ 371 Date: Jun. 23, 1997

§ 102(e) Date: Jun. 23, 1997

[87] PCT Pub. No.: WO96/20339

PCT Pub. Date: Jul. 4, 1996

[30] Foreign Application Priority Data

Dec. 27, 1994 [DE] Germany ..... 44 46 905.5

[51] Int. Cl.[6] ..... F02D 31/00

[52] U.S. Cl. ..... 123/357; 73/119 A; 123/372

[58] Field of Search ..... 123/357, 358, 123/359, 372; 73/119

[56] References Cited

U.S. PATENT DOCUMENTS

| | | | |
|---|---|---|---|
| 3,718,123 | 2/1973 | Eckert | 123/357 |
| 4,206,634 | 6/1980 | Taylor | 73/119 A |
| 4,243,004 | 1/1981 | Ritter | 123/358 |
| 4,387,589 | 6/1983 | Larson | 73/119 A |
| 4,432,320 | 2/1984 | Brasseur | 123/357 |
| 4,523,562 | 6/1985 | Schnapper et al. . | |
| 4,596,216 | 6/1986 | Speed | 123/357 |
| 4,773,370 | 9/1988 | Koshizawa | 123/357 |
| 4,850,320 | 7/1989 | Wokan | 123/359 |
| 4,912,968 | 4/1990 | Northdurft | 73/119 A |
| 5,265,569 | 11/1993 | Egashira | 123/357 |
| 5,339,781 | 8/1994 | Osawa | 123/357 |

FOREIGN PATENT DOCUMENTS

| | | |
|---|---|---|
| 3830534 | 4/1989 | Germany . |
| 3011595 | 3/1990 | Germany . |

*Primary Examiner*—Carl S. Miller
*Attorney, Agent, or Firm*—Bachman & LaPointe, P.C.

[57] ABSTRACT

A fuel injection pump unit consists of a fuel injection pump (1), in which a quantity-determining member (6) is set by an actuator (13), its position being detected by a position sensor (15), and of a control unit (2) which calculates an injection quantity (M) and from that, using a stored ignition characteristic (33), determines a set value ($\beta_{set}$) for the quantity-determining member (6). To provide a simple and precise calibration of the pump unit with minimal complexity, there are two adjustable stop faces (21, 22) which delimit the travel of the quantity-determining member (6) and in each case define a position of the quantity-determining member ($\beta_1$, $\beta_2$) commensurate with a certain measured injection quantity ($M_1$, $M_2$), in each case at a certain distance ($k_1$, $k_2$) from their opposite surfaces (23, 24), at least one of them being selected so that contact is not made with the opposite surface (23, 24) unless the quantity-determining member reaches points outside its dynamic adjustment range for injection quantity.

8 Claims, 3 Drawing Sheets

FUEL INJECTION PUMP UNIT WITH CONTROL AND PROCESS FOR ITS CALIBRATION

BACKGROUND OF THE INVENTION

The invention relates to a fuel injection pump unit, comprising a fuel injection pump wherein a control rod is displaced by an actuator and its position monitored by a position pickup, and a control unit which calculates an injection rate, from which injection rate a signal representative of a desired position of the element determining the injection rate is determined using stored characteristic values, and a control signal for the actuator is generated by a position controller by comparing the desired control rod position signal with an actual position signal furnished by the position pickup, stop means limiting the course of the control rod. The stored characteristic values give the correlation of injection rate (usually $mm^3$ per stroke) and course of the control rod as a function of engine parameters (for instance engine revs) usually, but not necessarily as a characteristic mapping.

From DE 38 30 534 C, a process for readjusting a group of unit injectors actuated from a common control rod is known, whereby for correcting the measurement errors of the position pickup, two fixed stop means which are a known distance apart are struck and the corresponding pickup signals are used for correcting subsequently measured values. In this way, the position controller always compares the desired course of the control rod determined from the characteristic mapping with corrected, thus correct, actual values of the course of the control rod, in order to elaborate the output signal for the control rod. The characteristic mapping itself, instrumental to calculating the desired course of the control rod from the desired injection rate, remains completely unaffected thereby.

Further, from DE 30 11 595 A a correction circuit for a fuel metering system with drift compensation is known, where the correlation between injection rate and the position of the control rod in an operating point is corrected so as to make the signal equal to the original (before drift occurred) desired value signal correlating with this operating point. To this end, the original feedback signal is in this case adjusted to a certain injection rate. The expenditure is, however, considerable: The correlation is modified during operation with speed-control in the idling operating point until the position controller reaches the value correlating with the actual operating point; this requires an additional adjusting device. This method is time-consuming and requires either an elaborate pickup or the superposition of an additional error signal.

This gives a fairly accurate feedback signal, but the injection-pump-related accuracy of the desired value for each individual pump (differing from other individuals due to manufacturing tolerances), is at least equally important for accurate positioning of the control rod. These inaccuracies are not taken account of. Only an accurate feedback signal together with an accurate desired value safeguard accurate control of the injection rate. Modern diesel engines require highest accuracy of the injection rate for each individual cylinder. Foremost, this is in order to keep the air/fuel ratio and therewith toxic emissions within a very narrow range and in order to fully exploit the maximal rated performance, in case of individual injection pumps the maximal rated performance of each cylinder. As minimizing emissions of NOX requires measures contradictory with those required for minimizing the emission of particles, and as the optimal trade-off is restricted to a very narrow range of air/fuel ratios, the importance of accurate adjustment of the injection rate for minimizing emissions cannot be exaggerated. Minimizing emissions often requires also an accurate control of exhaust gas recirculation (EGR).

The accuracy of the desired value of the position of the element which determines the injection rate depends on the identity of the characteristic map of the injection pump with its actual individual pumping behavior, which not only depends on speed, but also on counter-pressure, thus fuel conduits and resistance in the injection nozzle, which also differ individually. The influence of resistances and leakage is particularly great and disturbing in injection pumps for highest injection pressures, even more so if in addition the injection rate is modulated by temporary reduction of the injection cross section.

Therefore, it is common practice to thoroughly measure each individual pump before fitting to the engine, and to adjust one stop and to use a standard correction value. This correction value takes account of the level, but not the gradient of the characteristic curve of the individual pump. The individual pumps are thus still in a wide range of tolerances which cannot be taken account of. An other possibility is to sort the pumps by category and use the same correction values for each category. But this only leads to slightly improved results with a much higher expenditure. If later, individual pumps or nozzles are exchanged, the correction values are wrong, which causes further problems. These known methods are therefore too inaccurate for minimizing emissions and cause further problems if individual units are exchanged.

It is therefore the object of the invention to design and operate injection pump units so as to allow, with a minimum of expenditure the accurate calibration of the pump units upon fitting, their automatic calibration and later recalibration.

SUMMARY OF THE INVENTION

According to the invention, this is achieved in that the stop means are adjustable and in that fixed distances are stored in the control unit, the fixed distances being the distances between the stop means and stop faces corresponding to measured injection rates, at least one of the stop faces being located so as to strike the corresponding stop means outside the dynamic control range of the injection rate.

The two stop means do not only allow the calibration of the position signal, their effect goes much further. By adjusting both stop means in such a way that they exactly correspond (correspond, because of the constant difference established by the constant distances) each time to the position of the element determining the injection rate, at an exactly measured injection rate and at a certain speed—already on the pump test bench, position and gradient of the characteristic curve of each individual pump are fully taken into account; this means that thanks to the so adjusted stop means, the course of the control rod between the two stop means is different for each individual pump. In this way, the individual calibration of each individual pump unit before fitting to the engine is executed fast and accurately.

As, furthermore, the correspondence between the difference of the output signals of the position pickup and the course of the element determining the injection rate is known, it is also known what difference of the signals corresponds to the constant distance. As the latter is much smaller than the entire stroke of the control rod, the correspondence between the difference of the output signals of the position pickup and the course of the control rod need not be very accurate, or the very pickup need not be very accurate.

If a so calibrated pump unit is fitted to the engine, only the signals from the position pickup corresponding to the two stop means and the constant differences need to be furnished to the control unit and stored in its memory. Calibration now is completed. From the last mentioned two signals, from the constant distances and from the correspondence between difference of the signals and course of the control rod, the control unit can at any time determine the accurate desired position of the control rod for each desired injection rate and the actual injection rate from each signal of the position pickup.

The constant distance between the stop means and the stop faces shaped accordingly safeguard that the stop means do not interfere with the displacement of the control rod. This is so, because transition from full load to idling requires—for dynamic reasons—the control rod to be displaced into a position corresponding to a lower injection rate than that for idling. This safeguards furthermore that the engine stops on its own if for instance the position pickup suffers a short-circuit. One of the constant distances is previously determined such that the control rod assumes the position for injection rate equal zero when it strikes the stop means. The value of the constant distance can thus be chosen the same for a certain size of pumps. This facilitates the exchange of a pump unit, because no interference with the control unit is required. The correlation between control unit and the individual pump unit occurs automatically with the first striking of the two stop means.

The constant distance for adjustment is most easily represented by a caliber (a gage body of the thickness k inserted between stop means and stop face); but it could also be kept by a suitable electronic or optical device.

With injection pumps whose design is such that injection pressure drops before the maximum injection rate is reached, only the stop means cooperating with the stop face outside the dynamic control range is the stop means for the smaller of the measured injection rates.

With the customary design of injection pump units, it is advantageous, because simpler and more practical, if the stop means are stationary, whereas the control rod bears the stop faces.

In a first embodiment, the measured injection rates are the injection rate for idling speed and the injection rate for full load, in a second embodiment, the measured injection rates are the rates measured at two distant part-load points. The latter is preferable if the characteristic curve is strongly curved, because it minimizes the errors at medium partial load.

In a development of the invention, the characteristic values can be replaced by a theoretically calculated characteristic curve. As the stop means according to the invention allow the characteristic curve to be stretched, compressed and rotated, individual differences of the pump units can be equalized by way of calibration. This makes calibration and adjusting particularly simple, while most of the accuracy is maintained.

The application of a pump unit according to the invention as part of a unit injector where each of the fuel injection pump units has its own control rod is particularly advantageous. As calibration is performed on the already assembled unit injector, the differences in throttling losses can be taken account of with the same accuracy. This maximizes the advantage that each cylinder works emission-optimized and can be operated at maximum rating. The same also applies to individual pump units inserted near the corresponding injection nozzle.

The invention also relates to a process for calibrating a fuel injection pump unit according to the invention, which can be executed in two different ways. First for adjustment when assembling the pump with subsequent automatic calibration (other word: correlating) when uniting the pump with the pickup and the control unit, e.g. when fitting the unit; second, later for regular recalibration, for instance every time the engine is started. The latter either in order to equalize degradations occurring during service life, or in order to automatically recalibrate after exchanging the pump unit, the pump, the control unit or the pickup.

Proceeding according to claim 8 results in a completely calibrated complete injection pump unit which can be fitted to the engine without any further adjustments, be it when assembling a new engine, be it as a spare part. In case of a unit injector this also results in a narrow adaptation to the throttling losses of the individual injection nozzles. The required expenditure of time is limited to adjustment of the pump on the test bench by adjustment of the two stop means. The command to automatically strike the stop means is part of the command program, which is stored in the memory of the control unit.

Thanks to this command program, a so calibrated pump unit will subsequently, when fitted in the vehicle, also be repeatedly recalibrated by striking the stop means, foremost in order to equalize degradations of the position pickup (aging, drift). The pump unit thus is self-calibrating. As such degradation proceed only slowly, recalibration is not necessary each time the engine is started.

BRIEF DESCRIPTION OF THE DRAWING

In the following, the invention shall be described and explained along with the following figures which show.

DETAILED DESCRIPTION

Figure 1:
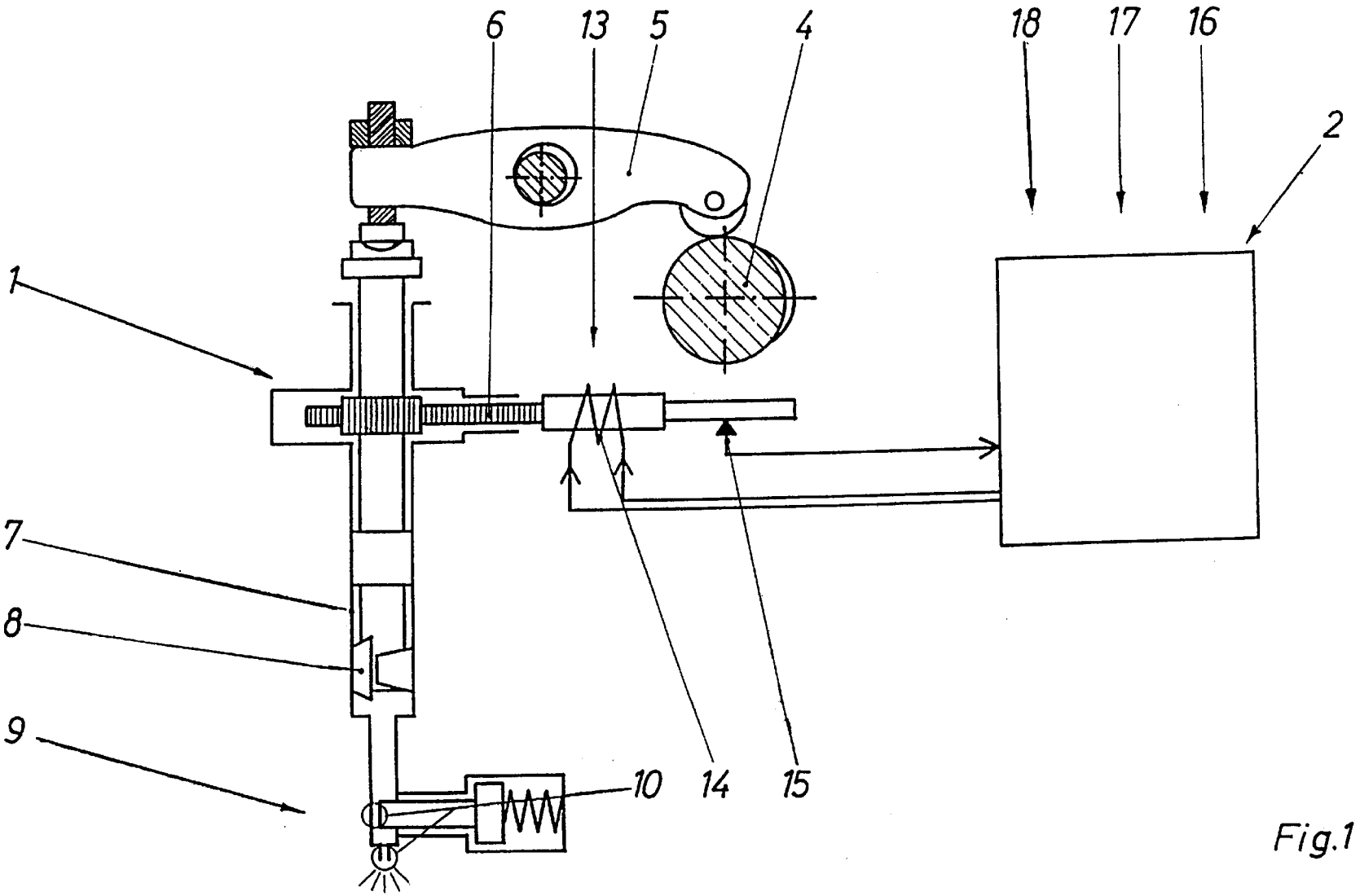
FIG. 1: schematically an injection pump unit suitable for the application of the invention.

The injection pump unit shown in FIG. 1 consists of an injection pump 1 and a control unit 2. In the injection pump, a piston 3 is reciprocates, driven for instance from a camshaft 4 by means of a rocker arm 5. Piston 3 can be rotated by means of a control rod 6, in the embodiment shown a shiftable control rod, whereby the injection rate is adjusted, in a known manner due to the shape of lands machined either in the pump body 7 or on the piston 3. In the shown embodiment, an injection nozzle 9 is immediately adjacent the pump body 7 underneath, the throttling passages influencing the pattern of the injection bear the reference number 10. The shown injection pump is thus a unit injector, but the invention is applicable in the same manner in a disposition, where the injectors are separate from the injection pump.

The control rod 6 is shifted by an actuator 13, symbolized by a solenoid 14. Further, there is a position pickup 15 furnishing to the control unit 2 a signal β (of whichever dimension, e.g. electric tension capacity or frequency). The control unit 2 is further supplied with a load demand signal 16, e.g. from the accelerator pedal of the vehicle, an engine rev signal 17 and various other signals 18, necessary for calculating the injection rate, e.g. barometric pressure and temperature.

Figure 2:
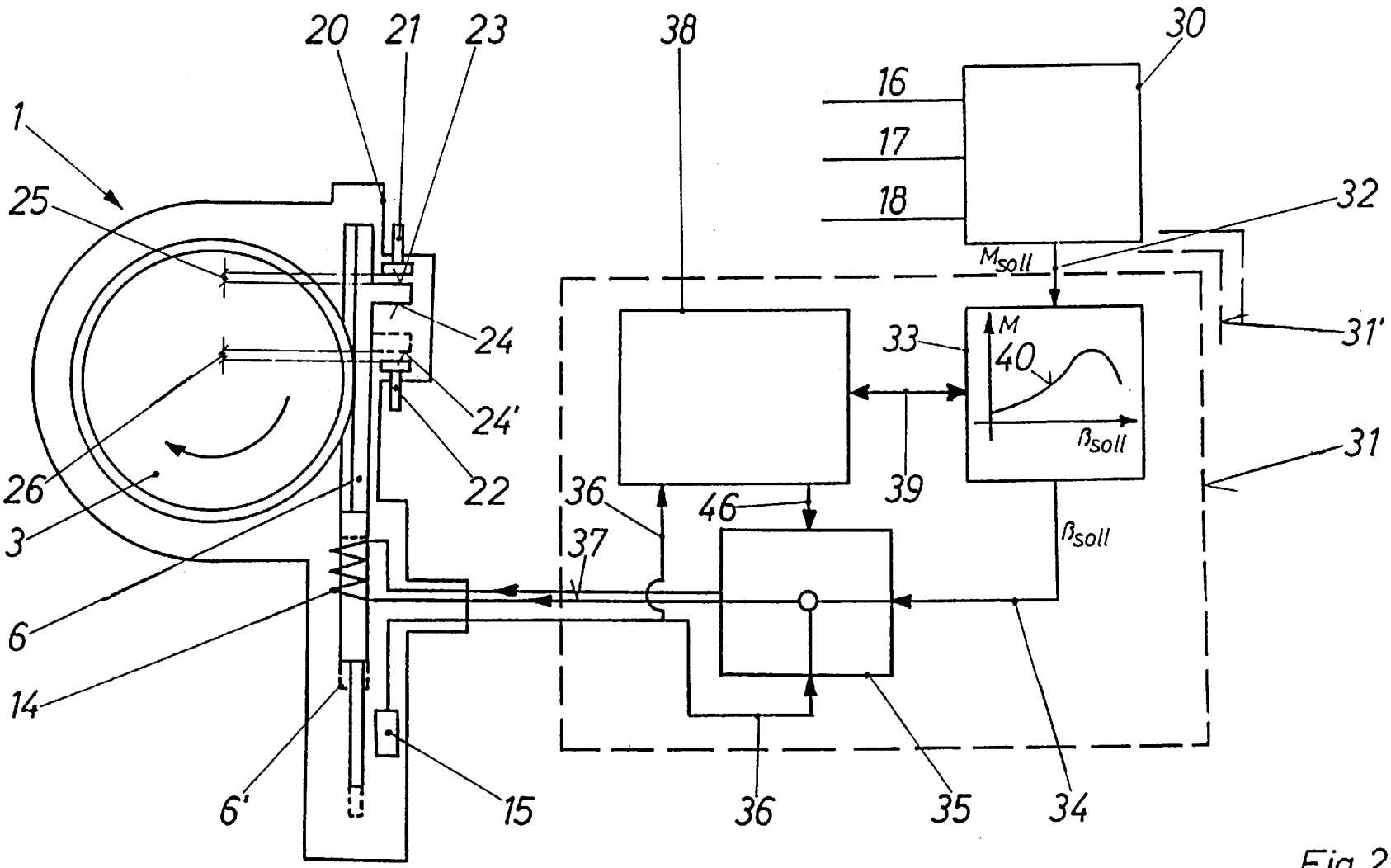
FIG. 2: the same pump unit as in FIG. 1 viewed from the top and designed according to the invention.

FIG. 2 shows the injection pump 1 only as seen from a bird's eye. The upper part of the pump piston 3 can be recognized, it is rotated by translation of the control rod 6 in order to command the injection rate. In the pump casing 20, two stop means 21,22 are adjustably secured, cooperating with stop faces 23,24 of the control rod 6. The stop means 21,22 preferably bear a screw thread each for accurate adjustment and securing against rotation. In the position marked in through lines, corresponding for instance to the idling injection rate $M_1$, there is a distance $k_1$ (25) between the stop face 23 of the control rod and the stop means 21. In the position 6' marked in broken lines of the control rod 6, for instance corresponding to the injection rate $M_2$ for full load, there is a distance $k_2$ (26) between stop means 22 and the stop face 24'. This will be described in more detail when explaining the function.

The control unit 2 comprises a computer 30 calculating the required injection rate $M_{soll}$ from the load demand signal 16, the engine rev signal 17 and the other signals 18, and comprises a commanding section 31 for the individual injection pump. In case of individually commanded injection pumps (unit injectors), a plurality of such commanding sections 31' is provided. The required injection rate $M_{soll}$ calculated in computer 30 is furnished via conduit 32 to unit 33 of the commanding section 31, where a signal $\beta_{soll}$ representative of the desired value of the course of the control rod 6 is calculated with the help of a characteristic curve 40 of the pump (which can be general or only defined by a few points). This signal $\beta_{soll}$ is furnished to the position-controller 35 via a conduit 34. In the position controller 35, the signal representative of the actual position furnished by the position pickup 15 is compared with the signal representative of the desired position, and the solenoid 14 is commanded accordingly via conduit 37.

Finally, there is a memory 38 having access to the signal furnished by the position pickup 15 and which memory is linked to the unit 33 by the data conduit 39 in order to shift or rotate the pump characteristic curve 40 according to the data recorded when the stop means have been struck, so to correlate these to the command. The memory contained in 38 furnishes the command for striking the stop means via conduit 46 to the position controller 35. The units 33, 35, 38 are not necessarily separate functional units, they could also be programma-modules of a stored-programma computer.

Figure 3:
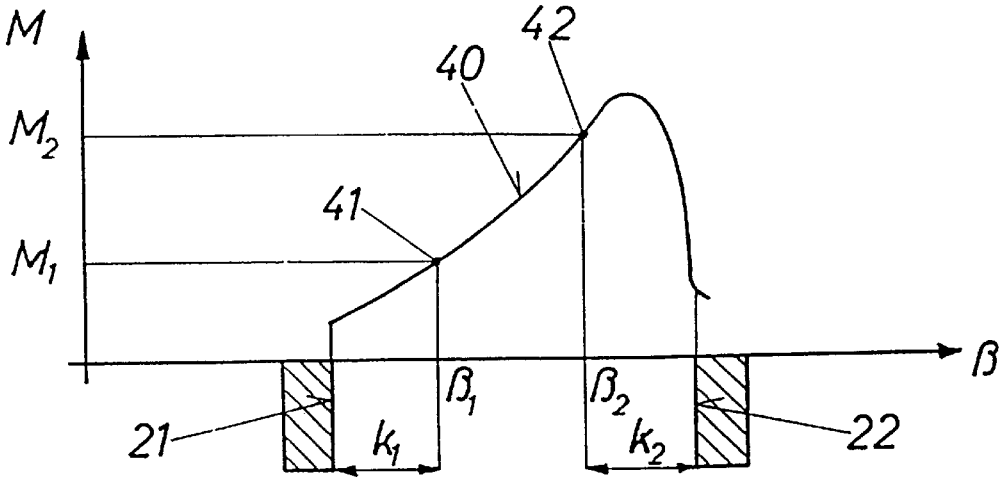
FIG. 3: a characteristic curve from the characteristic mapping of an individual pump.
Figure 4:
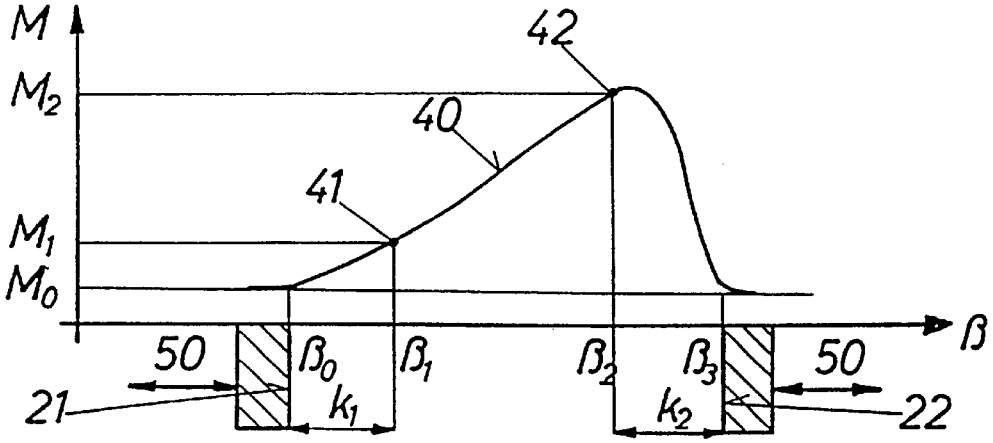
FIG. 4: a characteristic curve from the characteristic mapping of a different individual pump of the same series during calibration before fitting.
Figure 5:
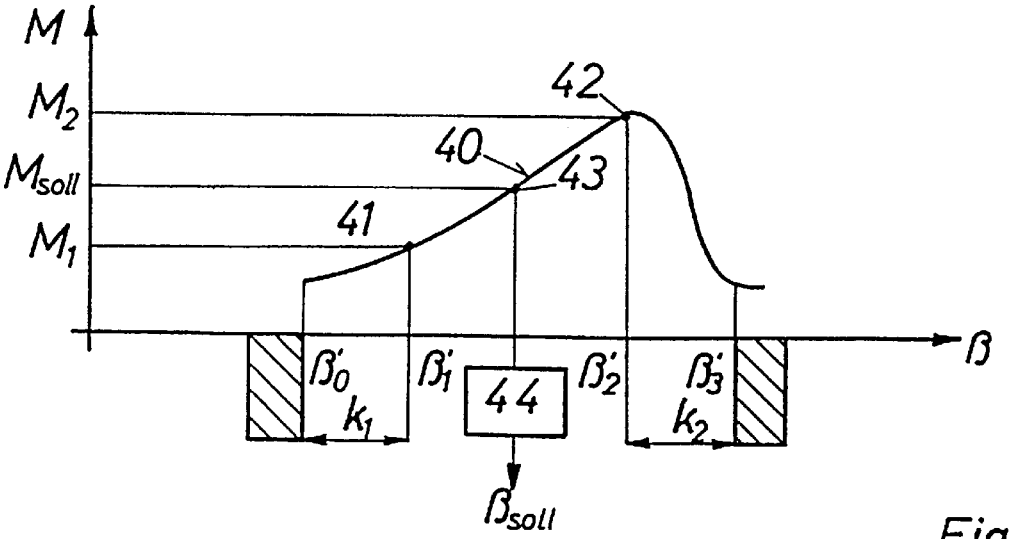
FIG. 5: the same characteristic curve as in FIG. 4, but during subsequent recalibration.

In the diagrams of the FIGS. 3, 4 and 5, the course $\beta$ of the control rod is the ordinate, and the injection rate M the abscissa. The characteristic curve 40 of the pump has two characteristic points 41, 42. 41 is the idling point at the idling injection rate $M_1$ and the course $\beta_1$ of the control rod; 42 is the full-load point at the full-load injection rate $M_2$ and the course $\beta_2$ of the control rod.

Each of the FIGS. 3 and 4 shows the individual characteristic curve of a pump unit of the same type. The differences in position and gradient of the two curves can be seen, they result from manufacturing tolerances.

These differences are identified and fully compensated by the pump unit and the process according to the invention. This will now be described with regard to FIGS. 3 and 4:

The individual pump is put on the pump test bench (FIG. 4) for calibration. First the pump is run in the idling point 41 with idling revs. In order to do this, the element determining the injection rate (in the following short: control rod) is translated until the idling injection rate $M_1$ is reached. Then the control rod 6 is blocked and the stop means 21 is adjusted (double arrow 50), until its distance from the stop face 23 has the value $k_1$, predetermined summarily and stored in the memory at 38. $k_1$ is chosen such that the injection rate is equal or nearly equal to zero when the stop means is struck directly. In this position, stop means 21 is set and secured. In the same way, the pump then is run in the full-load point 42 with suitable revs, the stop means 22 adjusted for a distance $k_2$ and secured. The injection pump proper is now purely mechanically adjusted and ready to be fitted.

As soon as the pump proper is united with the pickup 15 and the control unit 2, which can occur in a later phase of assembly or only when being fitted to the engine or if recalibrating later on, the stop means 21 is first struck directly and the position signal $\beta_0$ is stored in the memory. Then, the stop means 22 is struck directly and the position signal $\beta_3$ is stored in the memory. The predetermined distances $k_1$ and $k_2$ are already or are likewise stored in the memory. Therewith, calibration is accomplished. The predetermined distances are preferably realized by means of a distance gage.

From the two position signals $\beta_0$, $\beta_3$, the constant distances $k_1$, $k_2$ and from the correlation between the difference of the pickup signals and the actual course of the control rod, the control unit can determine the pickup signals $\beta_1$ and $\beta_2$ correlated with the injection rates $M_1$ and $M_2$ and further at any time and for any injection rate $M_{soll}$ the accurate desired pickup signal $\beta_{soll}$, or inversely, for any pickup signal the actual injection rate. The adjustment of the characteristic curve 40 of the pump in 33 thus has been performed taking account of the possibly error-ridden position signal. Therefore, a separate correction of the pickup signal is not necessary.

With regard to FIG. 5, the recalibration of the injection pump unit, repeatedly performed later on, shall be described, although it is as previously described. For this purpose, the control rod 6 is shifted in both directions by the actuator 13, each time until the stop means 21, 22 strike the stop faces 23, 24 before starting the engine. The signals of the pickup 15 when the two stop means 21, 22 are struck ($\beta_0'$,$\beta_3'$), now differ from those stored in memory 38 during the original calibration, if for instance the behavior of the pickup has deteriorated since the last calibration or recalibration. As the respective stop means remained in place, a corrected position signal $\beta_1'$ is correlated to the idling point 41, and a corrected position signal $\beta_2'$ is correlated to the full-load point 42.

Therewith, the curve 40 is corrected and corrected control rod positions $\beta_1'$, $\beta_2'$ are correlated to the injection rates $M_1$, $M_2$. during operation, intermediate values are again determined by interpolation. An injection rate $M_{soll}$ corresponds to a point of operation 43 on the characteristic curve 40; from this point, a $\beta_{soll}$ is generated by interpolation, indicated by box 44, this $\beta_{soll}$ is directly furnished to the position controller 35 where it is compared with the signal $\beta$ coming directly from the position pickup 15, and the control rod is shifted accordingly.

If with any particular type of pump, the characteristic curve 40 is excessively buckled, linear interpolation could lead to errors, the operating points 41,42 can also be chosen as partload points some (but a smaller) distance apart. Linear interpolation than entails a smaller error.

Furthermore, FIGS. 4 and 5 show that the constant distances $k_1$,$k_2$ are chosen so that a stop means 21,22 are so far remote from the operating points 41,42 (idling and full load), that the curve 40 there reaches the value $M_0$, this being injection rate zero. Altogether the invention creates a most simply calibrated and self-calibrating system, which safeguards full and intrinsic safety.

I claim:

1. Fuel injection pump unit comprising:

a fuel injection pump, a displaceable control rod for adjusting the quantity of fuel injected per stroke of the pump, a position pickup for monitoring the position of the control rod, an actuator for displacing the control rod, a control unit which calculates a quantity of fuel to be injected $M_{soll}$ and from which a signal $\beta_{soll}$ which is representative of a desired position of the control rod is determined using stored characteristic values, a position controller for generating a control signal for the actuator for adjusting the control rod by comparing the desired control rod position signal $\beta_{soll}$ from the control unit with an actual position signal $\beta$ furnished by the position pickup, and adjustable stop means for limiting the displacement of the control rod wherein the stop means are adjustable to fixed distances $k_1$, $k_2$ from stop faces on the control rod, the distances $k_1$, $k_2$ are stored in the control unit and correspond to measured injection quantities $M_1$, $M_2$ wherein $M_1$ is the idling injection quantity and $M_2$ is the full load injection quantity and wherein at least one of the stop means is located so as to strike the corresponding stop face at a position corresponding to a value $M^*$ where $M^*<M_1$ or $M^*>M_2$ when a signal from the control unit overshoots a Value corresponding to $M_1$ or $M_2$ but does not reach $M^*$.

2. In a fuel injection pump unit comprising a fuel injection pump, a displaceable control rod for adjusting the quantity of fuel injected per stroke of the pump, a position pickup for monitoring the position of the control rod, an actuator for displacing the control rod, a control unit which calculates a quantity of fuel to be injected $M_{soll}$ and from which a signal $\beta_{soll}$ which is representative of a desired position of the control rod is determined using stored characteristic values, a position controller for generating a control signal for the actuator for adjusting the control rod by comparing the desired control rod position signal $\beta_{soll}$ from the control unit with an actual position signal $\beta$ furnished by the position pickup, and adjustable stop means for limiting the displacement of the control rod wherein the stop means are adjustable to fixed distances $k_1$, $k_2$ from stop faces an the control rod, the distances $k_1$, $k_2$ are stored in the control unit and correspond to measured injection quantities $M_1$, $M_2$ wherein $M_1$ is the idling injection quantity and $M_2$ is the full load injection quantity and wherein at least one of the stop means is located so as to strike the corresponding stop face at a position corresponding to a value $M^*$ where $M^*<M_1$ or $M^*>M_2$ when a signal from the control unit overshoots a value corresponding to $M_1$ or $M_2$ but does not reach $M^*$, a process for calibrating the fuel injection pump unit comprising the steps of:

a) adjusting the stop means on a test-bench such that they have certain distances $k_1$, $k_2$ from their corresponding stop faces when the measured injection rates have certain values $M_1$, $M_2$;

b) striking both stop means and the stop force and storing the corresponding pickup signals $\beta_0$, $\beta_3$ corresponding to the positions of the control rod in the control unit (2); and c) determining from the control unit pickup signals $\beta_1$, $\beta_2$ corresponding to the measured injection rates $M_1$, $M_2$ from the distances $k_1$, $k_2$ and the pickup signals $\beta_0$, $\beta_3$, from which pickup signals $\beta_1$, $\beta_2$ the positions $\beta_{soll}$ of the control rod corresponding to the desired injection rate $M_{soll}$ during operation are determined.

3. Fuel injection pump unit according to claim 1, wherein said at least one of the stop means is the stop means for the value $M^*$ where $M^*<M_1$.

4. Fuel injection pump unit according to claim 1, wherein the stop means are stationary.

5. Fuel injection pump unit according to claim 1, wherein the measured injection quantities are the rates measured at two distant part-load points.

6. Fuel injection pump unit according to claim 1, wherein the characteristic values are determined by a theoretically calculated characteristic curve.

7. Fuel injection pump unit according to claim 1, wherein the unit is part of a unit injector having a plurality of pump units and each of the fuel injection pump units has its own control rod.

8. Process for calibrating a fuel injection pump originally calibrated according to claim 2 including the steps of before starting an engine equipped with the fuel injection pump unit, both stop means are struck and the actual pickup signals describing the position of the control rod, in which the stop faces and the corresponding stop means strike, are stored, and subsequently the signals furnished by the pickup and corresponding to the certain injection rates are corrected by the control unit (2) from the fixed distances and the new position signals.

* * * * *